US007484267B2

(12) United States Patent
Yeh

(10) Patent No.: US 7,484,267 B2
(45) Date of Patent: Feb. 3, 2009

(54) DEVICE WHICH CAN PREVENT A PULL ROD OF SUITCASE FROM BEING AUTOMATICALLY EJECTED OUT

(75) Inventor: Mark Yeh, Hsin Chuan (TW)

(73) Assignee: Trio Industries Co., Ltd., Taipei Hsien (TW)

( * ) Notice: Subject to any disclaimer, the term of this patent is extended or adjusted under 35 U.S.C. 154(b) by 310 days.

(21) Appl. No.: 11/410,857

(22) Filed: Apr. 24, 2006

(65) Prior Publication Data

US 2007/0245520 A1 Oct. 25, 2007

(51) Int. Cl.
*A45C 13/22* (2006.01)

(52) U.S. Cl. ..... 16/113.1; 190/115

(58) Field of Classification Search ..... 16/113.1, 16/114.1, 405, 406, 429, DIG. 41; 190/115, 190/116, 117, 18 A; 280/655, 655.1
See application file for complete search history.

(56) References Cited

U.S. PATENT DOCUMENTS

| | | | | |
|---|---|---|---|---|
| 5,570,491 | A * | 11/1996 | Tung | 16/113.1 |
| 6,295,698 | B1 * | 10/2001 | Chang | 16/113.1 |
| 6,332,241 | B1 * | 12/2001 | Kuo | 16/113.1 |
| 6,918,476 | B2 * | 7/2005 | Chou | 190/115 |
| 2003/0009853 | A1 * | 1/2003 | Kuo | 16/405 |

* cited by examiner

*Primary Examiner*—Victor Batson
*Assistant Examiner*—Jeffrey O'Brien
(74) *Attorney, Agent, or Firm*—Pro-Techtor Int'l Services

(57) ABSTRACT

A device which can prevent a pull rod of suitcase from being automatically ejected out includes a counter weight which is installed in an inner lining of the pull rod. The counter weight is emplaced in a middle section of a frame slot of sliding rod. If the suitcase is fallen on a ground when a push button on a handle bar of pull rod is not pressed down, a blocking rod at one end of the counter weight will be automatically extended out of a concaved hole of an outer cover to retain a positioning block, so as to prevent the pull rod from being automatically ejected out due to an inadvertent condition.

1 Claim, 5 Drawing Sheets

DEVICE WHICH CAN PREVENT A PULL ROD OF SUITCASE FROM BEING AUTOMATICALLY EJECTED OUT

BACKGROUND OF THE INVENTION a) Field of the Invention

The present invention relates to a device which can prevent a pull rod of suitcase from being automatically ejected out, and more particularly to a device that if a suitcase is thrown on a ground when its push button on a handle bar of pull rod is not pressed down, the pull rod can be prevented from being automatically ejected out, by using a counter weight in an interior of the pull rod.

b) Description of the Prior Art

A conventional suitcase is provided with a retractable pull rod, such that when the pull rod is extended up, the suitcase can be dragged to move with a user. As a handle bar of pull rod is provided with a push button, the user has to press down the push button to unlock a locking device in an interior of the pull rod before extending the pull rod. During a process of transporting and throwing the suitcase, the pull rod will be still ejected out automatically, even without pressing down the push button, which will cause trouble to a working staff and will also break the pull rod.

SUMMARY OF THE INVENTION

The primary object of present invention is to install a counter weight device inside an inner lining of pull rod of suitcase, such that if the suitcase is fallen on a ground when a push button on handle bar of pull rod is pressed down, the pull rod can be prevented from being automatically ejected out, by using the counter weight.

To enable a further understanding of the said objectives and the technological methods of the invention herein, the brief description of the drawings below is followed by the detailed description of the preferred embodiments.

DETAILED DESCRIPTION OF THE PREFERRED EMBODIMENTS

Figure 1:
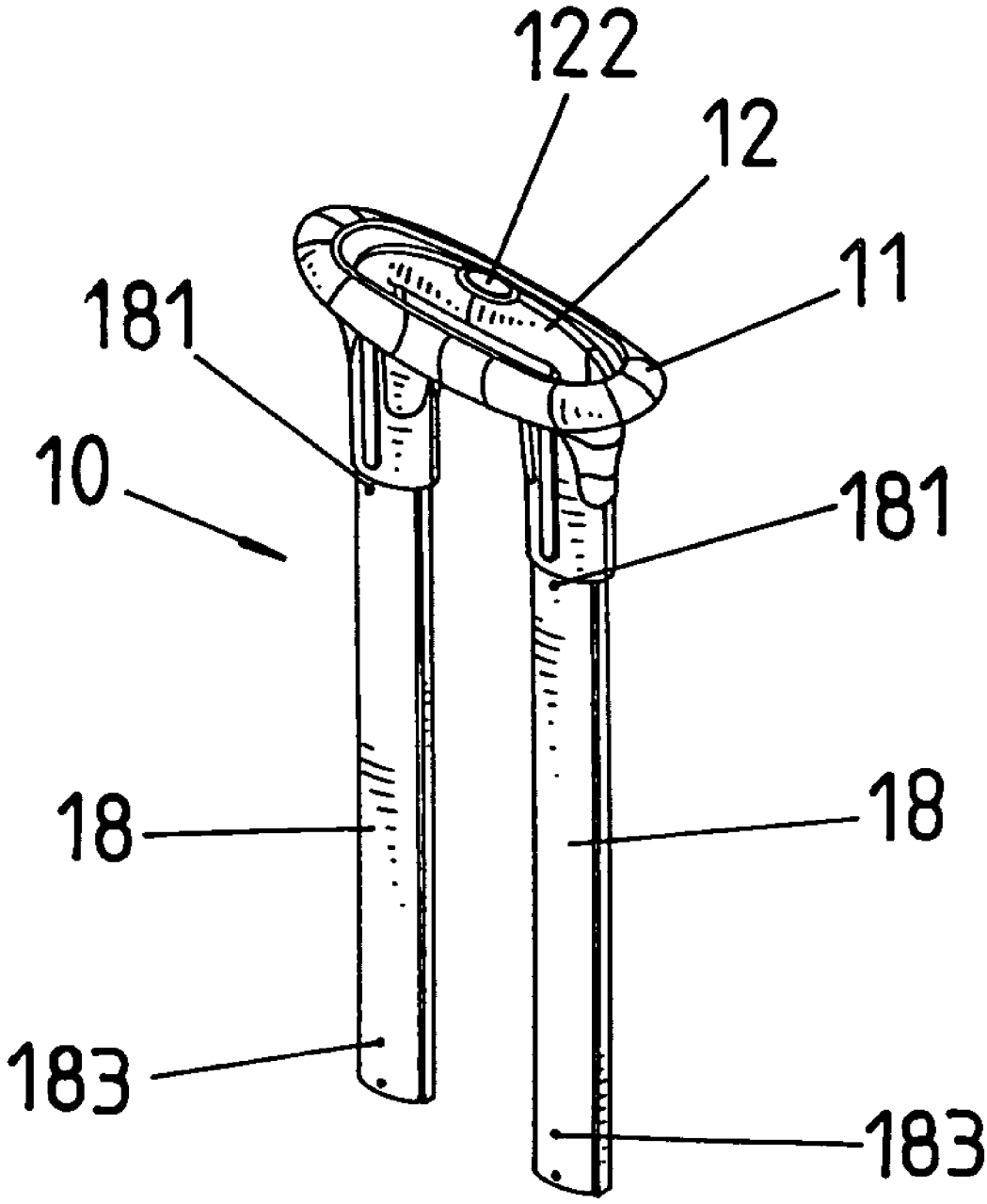
FIG. 1 shows a schematic view of an appearance of part of pull rod of suitcase of the present invention.
Figure 2:
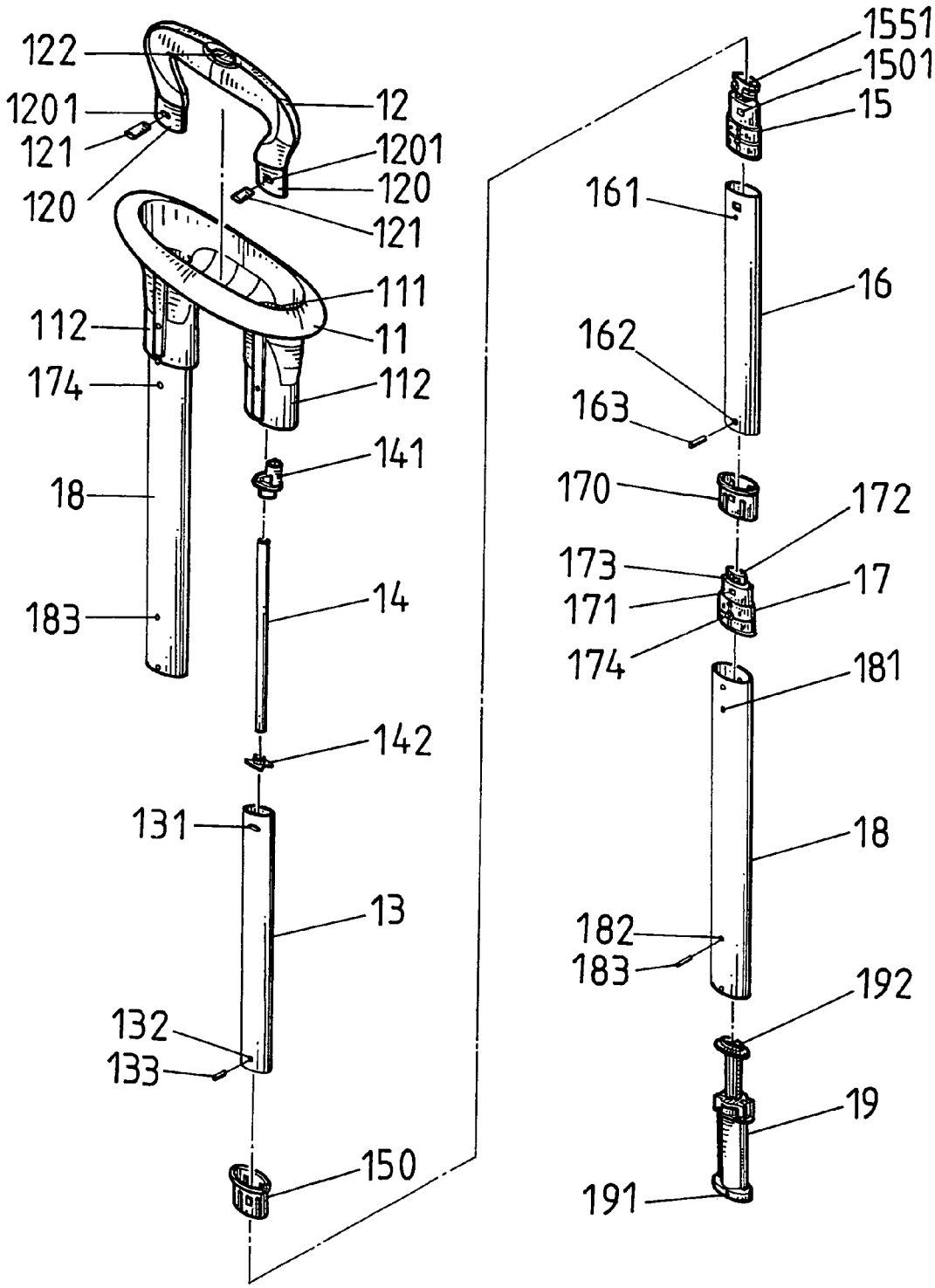
FIG. 2 shows an exploded view of a pull rod of the present invention.

Referring to FIG. 1 and FIG. 2, a pull rod 10 of suitcase is composed of a tube seat 11, a handle bar 12, two upper tubes 13, two transmission shafts 14, two inner linings 15, two middle tubes 16, two bi-directional inner sleeves 17, two lower tubes 18, and two ejection members 19. A seat hole 111 at a top end of tube seat 11 can provide for an emplacement of the handle bar 12, and two insertion pieces 120 of which can be inserted into the upper tubes 13. Two bolts 121 are transfixed into pinholes 131 of upper tubes 13 and pinholes 1201 of insertion pieces 120, respectively, to be positioned. Two lower tubes 18 are latched below the tube seat 11, the middle tubes 16 can be extended into the lower tubes 18, and the upper tubes 13 can be extended into the middle tubes 16. A top end of transmission shafts 14 inside the top tube 13 is connected at a bottom of push button 122 of handle bar 12 with a boot-shape kit 141, and a bottom end of the transmission shaft 14 is assembled with the inner lining 15 with a fixing seat 142.

Figure 4:
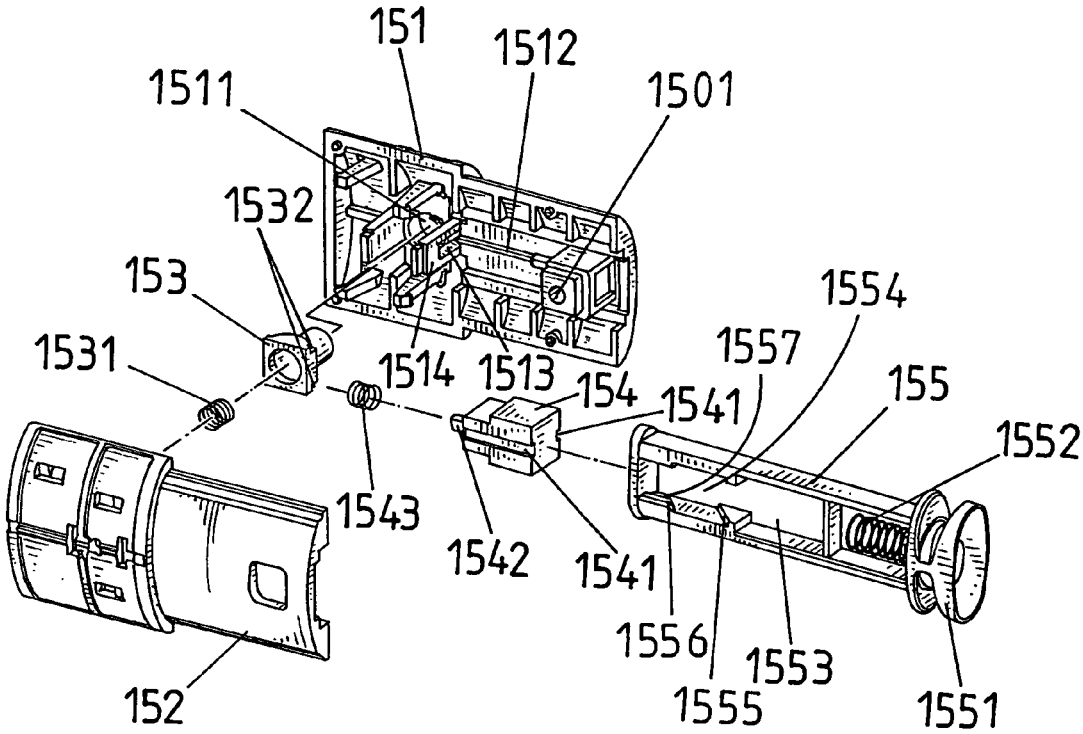
FIG. 4 shows an exploded view of an inner lining of pull rod of suitcase of the present invention.
Figure 5:
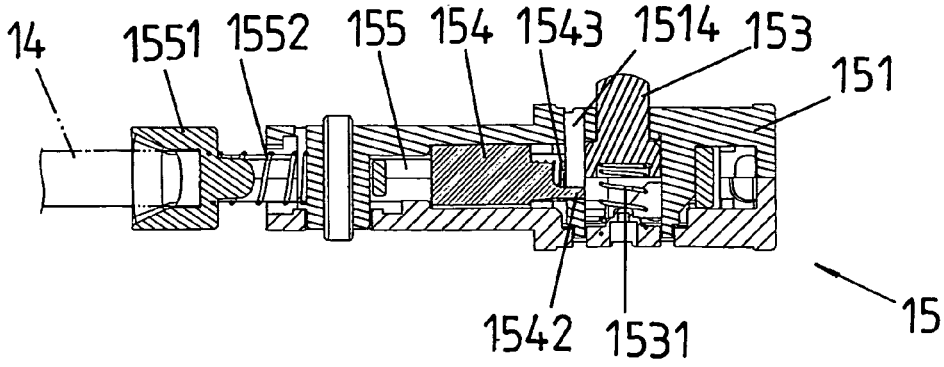
FIG. 5 shows a cross-sectional view of an inner lining structure of pull rod of suitcase of the present invention (when a counter weight is at a standstill).

An end of the transmission shaft 14 is extended into a cap 1551 of the inner lining 15 (as shown in FIG. 5), and a top end of the inner lining 15 is extended into a bottom part of the upper tube 13 and is assembled with the upper tube 13, using a positioning bolt 133 which is transfixed into a pinhole 132 at a bottom of upper tube 13 and is transfixed into a through-hole 1501 of inner lining 15. A top part of the inner lining 15 is sheathed with a sheath tube 150 which is fixed at an opening on a top end of the middle tube 16. A positioning hole 161 is located close to an opening on a top end of the middle tube 16, and can provide for an extension of positioning block 153 which is protruded at one end of the inner lining 15 (as shown in FIG. 4). A top end of the bi-directional inner sleeve 17 is extended into a bottom part of the middle tube 16 and is assembled with the middle tube 16, using a positioning bolt 163 which is transfixed into a pinhole 162 at a bottom of the middle tube 16 and an insertion hole 171 of the bi-directional inner sleeve 17. A pressing block 172 at a top end of the bi-directional inner sleeve 17 can squeeze a spring 173 to move inward and drive a positioning block 174 at its side to extend or retract. A top part of the bi-directional inner sleeve 17 is sheathed with a sheath tube 170 which is fixed at an opening on a top end of the lower tube 18, and a positioning hole 181 is located close to an opening on the top end of lower tube 18 and can provide for a protrusion of the positioning block 174 of bi-directional inner sleeve 17. The ejection member 19 (or spring) is emplaced inside the lower tube 18 to be positioned, using a positioning bolt 183 which is transfixed into a through-hole 182 at a bottom end of the lower tube 18 and a pinhole 191 of the ejection member 19. A top end of the ejection member 19 is provided with an elastic press bar 192, and a bottom part of which can be extended into the ejection member 19 to press and pull a spring (not shown in the drawings). A top end of the lower tube 18 is latched into a connection tube 112 of the tube seat 11 to form into an integral body.

FIG. 1 shows a condition when the upper tubes 13 and lower tubes 18 of pull rod 10 of a suitcase are not extended. When a user presses down the push button 122, the transmission shafts 14 can drive the positioning blocks 153 of inner linings 15 at the bottom ends of upper tubes 13 to retract inward, and the ejection members 19 can drive the upper tubes 13 and the middle tubes 16 to eject out of the lower tubes 18. In order to prevent that the pull rod 10 will be automatically ejected if the suitcase is fallen on a ground, when the push button 122 on handle bar 12 of pull rod 10 of suitcase is pressed down, a brand new inner lining 15 is designed to prevent the pull rod 10 from being automatically ejected out, by using a counter weight 154 (as shown in FIG. 3) inside the inner linings 15.

Figure 3:
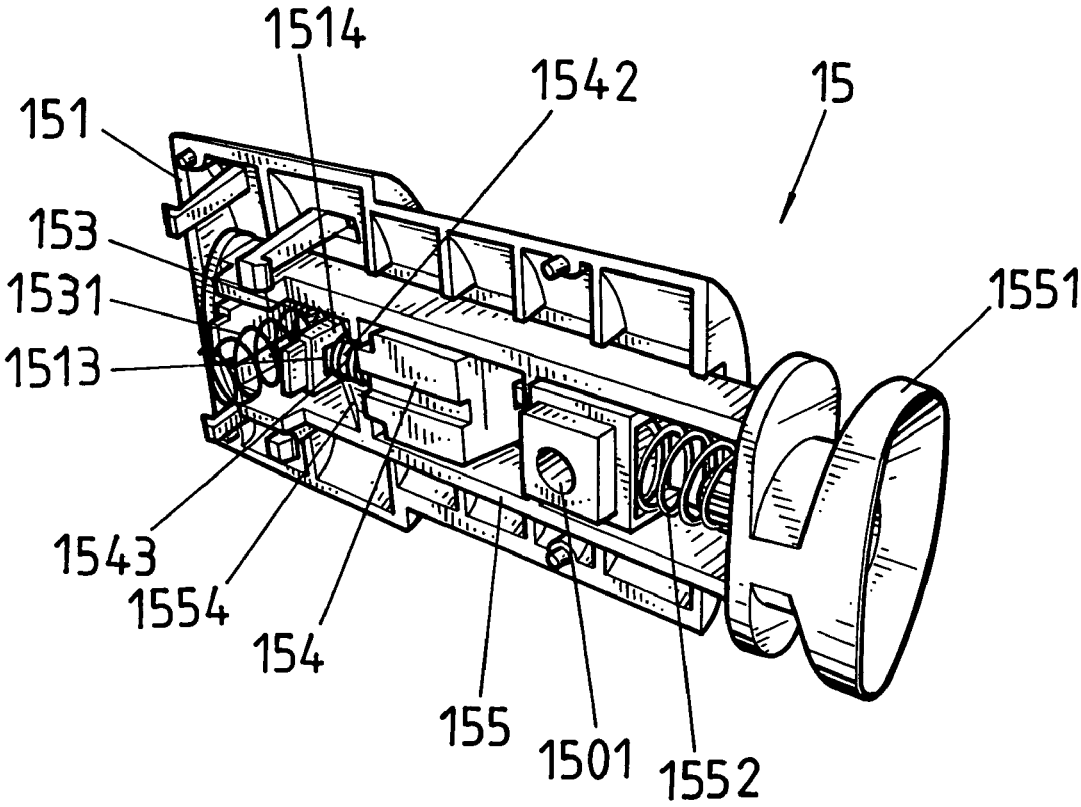
FIG. 3 shows a schematic view of an inner lining structure of pull rod of suitcase of the present invention.

Referring to FIG. 3 and FIG. 4, the inner lining 15 of present invention includes two outer covers 151, 152, one positioning block 153, one counter weight 154, and one sliding rod 155. An end of the positioning block 153 is protruded out of a through-hole 1511 at a side of the outer cover 151, and the other end is squeezing a spring 1531. The other end of the spring 1531 is abutted on an inner side of the other outer cover 152, and an end of the sliding rod 155 is emplaced inside the outer covers 151, 152. A cap 1551 at the other end is protruded out of exterior sides of outer covers 151, 152, and an interior of the cap 1551 can be sheathed with a spring 1552. The counter weight 154 can be emplaced into a frame slot 1553, and a slant track 1554 in an inner side of which can provide for an extension and retraction of the positioning block 153. The slant track 1554 is composed of two long slant blocks 1555 and two short slant blocks 1556, and a bottom part of the short slant block 1556 is provided with a blocking edge 1557. When the push button 122 of handle bar 12 is pressed down, the slant track 1554 of sliding rod 155 will be in tangential to a slope 1532 of positioning block 153 as if riding a slide, to successfully retract the positioning block 153 from the through-hole 1511 of outer cover 151, so as to facilitate the ejection member 19 to automatically eject out the handle bar 12. Two sides of the counter weight 154 are provided with grooves 1541 for being latched with raised strips 1512 at inner sides of the outer covers 151, 152, so as to facilitate a sliding of the counter weight 154. A front end of the counter weight 154 is provided with a blocking rod 1542 which can be transfixed into a concaved hole 1513 on a stud 1514 of outer cover 151. The blocking rod 1542 of counter weight 154 is also sheathed with a spring 1543.

Referring to FIG. 5, when the suitcase (or pull rod 10) is at a standstill, the blocking edges 1557 at bottom parts of two short slant blocks 1556 of slant track 1554 will retain the positioning block 153. At this time, the blocking rod 1542 of counter weight 154 is not transfixed into the concaved hole 1513 on stud 151 of outer cover 151 (the blocking rod 1542 does not retain the positioning block 153); therefore, the positioning block 153 can be retracted inward by normally pressing down the push button 122 of handle bar 12, so as to provide for an extension and collection of the handle bar 12.

Figure 6:
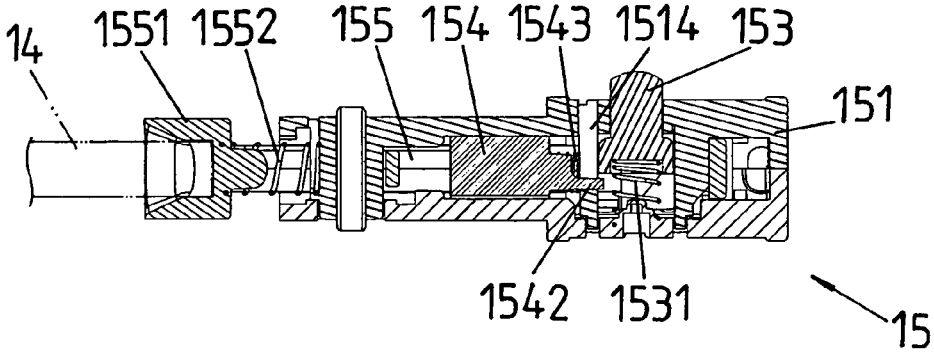
FIG. 6 shows a cross-sectional view of an inner lining structure of pull rod of suitcase of the present invention (when a counter weight is moving).
Figure 7:
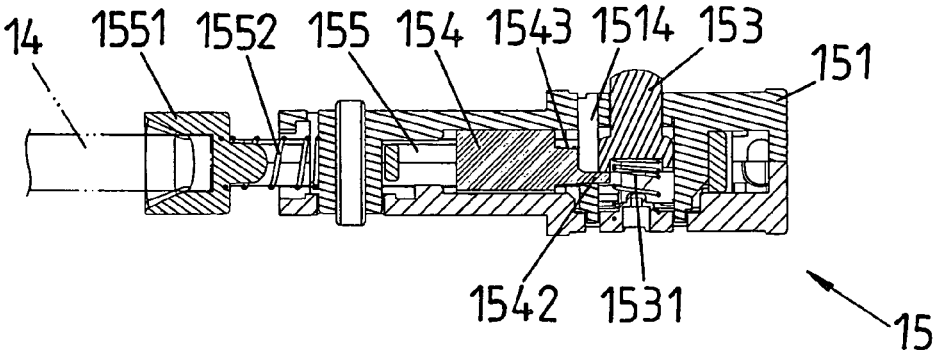
FIG. 7 shows a cross-sectional view of an inner lining structure of pull rod of suitcase of the present invention (after a counter weight is moved).

Referring to FIG. 6, when the suitcase is transported and thrown by a transportation personnel, the pull rod 10 is subjected to a collision with a ground, and the counter weight 154 will automatically squeeze the spring 1543. The blocking rod 1542 at one end will be protruded out of the concaved hole 1513 on stud 1514 of outer cover 151, and retain a tail end of the positioning block 153 (as shown in FIG. 7), which will prohibit the positioning block 153 from being retracted inward. Therefore, the pull rod 12 will not be automatically ejected out due to an inadvertent condition.

Accordingly, when the suitcase is transported and thrown on the ground by the transportation personnel (under the condition that the push button of handle bar of pull rod is not pressed down), the counter weight inside the inner lining of pull rod of present invention can effectively prevent the pull rod from being automatically ejected out.

It is of course to be understood that the embodiments described herein is merely illustrative of the principles of the invention and that a wide variety of modifications thereto may be effected by persons skilled in the art without departing from the spirit and scope of the invention as set forth in the following claims.

What is claimed is:

1. A device which can prevent a pull rod of suitcase from being automatically ejected out comprising a pull rod on a suitcase, with the pull rod being composed of a tube seat, a handle bar, two upper tubes, two transmission shafts, two inner linings, two middle tubes, two bi-directional inner sleeves, two lower tubes, and two ejection members; a seat hole of the tube seat configured to emplace the handle bar; two insertion pieces at a bottom part of the handle bar configured to be inserted into the upper tubes; two bolts being transfixed into pinholes of the upper tubes and the insertion pieces to be positioned; a top end of the handle bar being provided with a push button, and a bottom end of which being connected with the transmission shaft inside the upper tube, by using a boot-shape kit; a bottom end of transmission shaft being assembled with the inner lining by a fixing seat, and the transmission shaft configured to be extended into a cap of the inner lining; a top end of the inner lining being extended into a bottom part of the upper tube, and a positioning bolt being transfixed into a pinhole at a bottom part of the upper tube and a through-hole of the inner lining to be assembled together; a top part of the inner lining being sheathed with a sheath tube which is fixed at an opening on a top end of the middle tube; a positioning hole close to an opening on a top end of the middle tube configured to provide for an extension of a positioning block which is protruded at one end of the inner lining; a top end of the bi-directional inner sleeve configured to be inserted into a bottom part of the middle tube to be assembled together by using a positioning bolt which is transfixed into a pinhole at a bottom part of the middle tube and an insertion hole of the bi-directional inner sleeve; a pressing block at a top end of the bi-directional inner sleeve configured to squeeze a spring to move inward and to drive a positioning block at a side to extend and retract; a top part of the bi-directional inner sleeve being sheathed with a sheath tube which is fixed at an opening on a top end of the lower tube; a positioning hole close to an opening on a top end of the lower tube configured to provide for an extension of positioning block of the bi-directional inner sleeve; the ejection member being emplaced inside the lower tube to be positioned, using a positioning bolt which is transfixed into a through-hole at a bottom end of the lower tube and a pinhole of the ejection member; an elastic press bar at a top end of the ejection member; a top end of the lower tube being latched with a connection tube of the tube seat to form into an integral body; the inner lining including two outer covers, inner sides of which being provided with raised strips, a side of one of which being provided with a through-hole, and an inner side of one of which being provided with a stud containing a concaved hole; a positioning block, an end of which being protruded out of the through-hole of one outer cover, and the other end of which squeezing a spring, with the other end of spring being abutted on an inner side of the other outer cover; a sliding rod, an end of which being emplaced in the outer covers, and a cap at the other end of which being protruded out of an exterior side of the outer cover, with a spring being sheathed in an interior of the cap; configured such that that a counter weight is emplaced in a frame slot of sliding rod, a slant track, which is composed of two long slant blocks and two short slant blocks, at an inner side of the frame slot can provide for an extension and retraction of the positioning block, and a bottom part of the short slant block is provided with a blocking edge which can retain the positioning block when the pull rod is at standstill; upon pressing down the push button of the handle bar, the slant track of the sliding rod being tangential to a slope of the positioning block to retract it inward from the through-hole of the outer cover, with grooves at the two sides of the counter weight configured to provide for a latching with the raised strips of two outer covers; a blocking rod protruded at a front end of the counter weight configured to be extended out of the concaved hole of stud of outer cover, and being sheathed with a spring; when the suitcase is thrown on a ground without pressing down the push button on the handle bar of the pull rod, the blocking rod of the counter weight configured to retain a tail end of the positioning block to prevent the pull rod from being automatically ejected out.

* * * * *